US007275274B1

(12) United States Patent
Radford, Sr.

(10) Patent No.: US 7,275,274 B1
(45) Date of Patent: Oct. 2, 2007

(54) WATER METER ACCESSING TOOL SYSTEM

(76) Inventor: Benjamin L. Radford, Sr., 626 Koala Ct., Kissimmee, FL (US) 34759

( * ) Notice: Subject to any disclaimer, the term of this patent is extended or adjusted under 35 U.S.C. 154(b) by 0 days.

(21) Appl. No.: 11/329,733

(22) Filed: Jan. 12, 2006

(51) Int. Cl.
*B66F 15/00* (2006.01)
*B66F 11/00* (2006.01)

(52) U.S. Cl. ..... 7/166; 254/131

(58) Field of Classification Search ..... 7/166; 254/131; 294/12, 15, 17, 24, 26, 67.3; D8/14, D8/47

See application file for complete search history.

(56) References Cited

U.S. PATENT DOCUMENTS 574,811 A 1/1897 Lloyd
2,739,330 A * 3/1956 Hitchcock ..... 15/176.3
3,531,814 A 10/1970 Safalow
4,072,335 A * 2/1978 Tift et al. ..... 294/93
4,488,706 A * 12/1984 Kono ..... 254/131
4,741,060 A * 5/1988 Hose ..... 7/138
D442,051 S * 5/2001 Rines ..... D8/88
6,293,601 B1 9/2001 Johnson
D459,170 S 6/2002 Young
6,450,557 B1 9/2002 Martinez
2004/0217609 A1 11/2004 Freiling et al.
2005/0005970 A1* 1/2005 Lundeberg et al. ..... 137/371

FOREIGN PATENT DOCUMENTS

DE 3921366 A1 * 1/1991

* cited by examiner

*Primary Examiner*—David B Thomas

(57) ABSTRACT

A water meter accessing tool system includes a housing containing a water meter. A cover is mounted on the housing and is positionable over the housing in a closed configuration covering the water meter. The cover has an opening extending therethrough. A rod is attached to and extends away from a first end of the pole. The rod has a distal end positioned distal with respect to the pole. A plate is attached to the distal end. The plate has a first side, a second side, a pair of lateral edges and a free end. The plate has a thickness smaller than a width of the opening and a width greater than the width of the opening. The plate may be extended through the opening to engage the cover and so that the cover may be lifted off of the housing with the pole.

7 Claims, 4 Drawing Sheets

WATER METER ACCESSING TOOL SYSTEM

BACKGROUND OF THE INVENTION

1. Field of the Invention

The present invention relates to tool devices and more particularly pertains to a new tool device for removing a cover of a water meter housing to provide a person access to the water meter.

2. Description of the Prior Art

The use of tool devices is known in the prior art. While these devices fulfill their respective, particular objectives and requirements, the need remains for a device to assist a person in removing a cover from a water meter housing. Such covers are typically positioned in adjacent to a ground surface and are difficult to grip when being removed from the housing. For this reason, the tool will be a benefit to persons opening such housings.

SUMMARY OF THE INVENTION

The present invention meets the needs presented above by generally comprising a housing containing a water meter. A cover is mounted on the housing and is positionable over the housing in a closed configuration covering the water meter. The cover has an opening extending therethrough. The opening has a greater length than width. A pole is elongated and has a first end and second end. A rod is attached to and extends away from the first end of the pole. The rod is orientated parallel to the pole and has a distal end positioned distal with respect to the pole. A plate is attached to the distal end. The plate has a first side, a second side, a pair of lateral edges and a free end. The plate has a thickness smaller than a width of the opening and a width greater than the width of the opening. The plate may be extended through the opening to engage the cover and so that the cover may be lifted off of the housing with the pole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
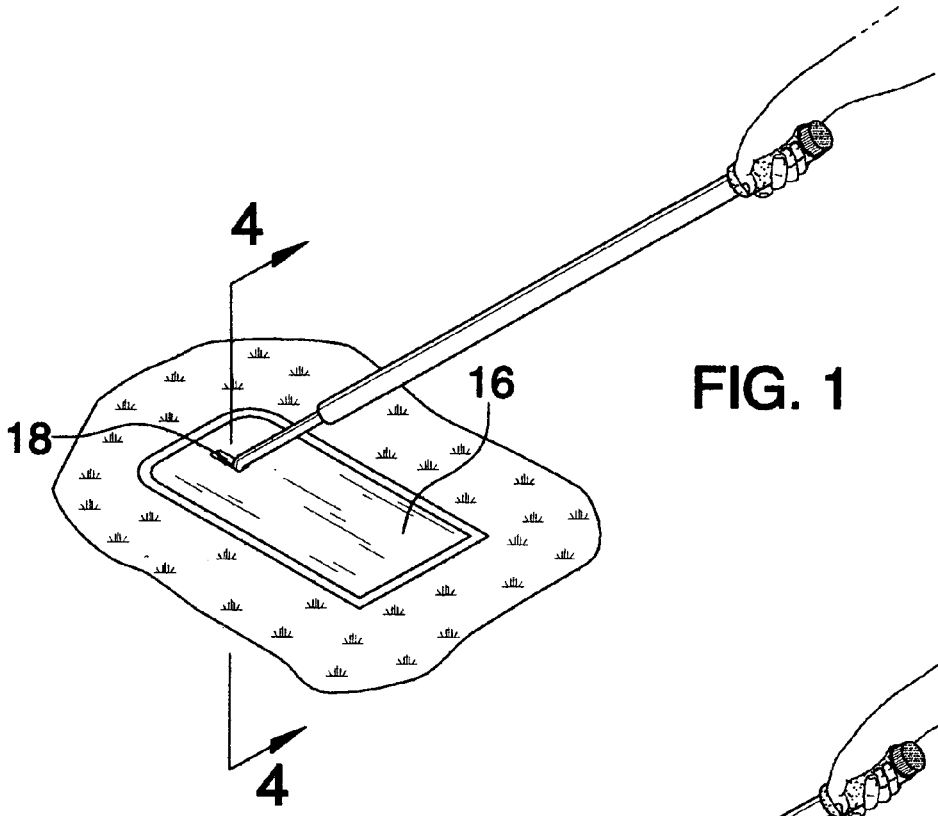
FIG. 1 is a perspective in-use view of a water meter accessing tool system according to the present invention.
Figure 2:
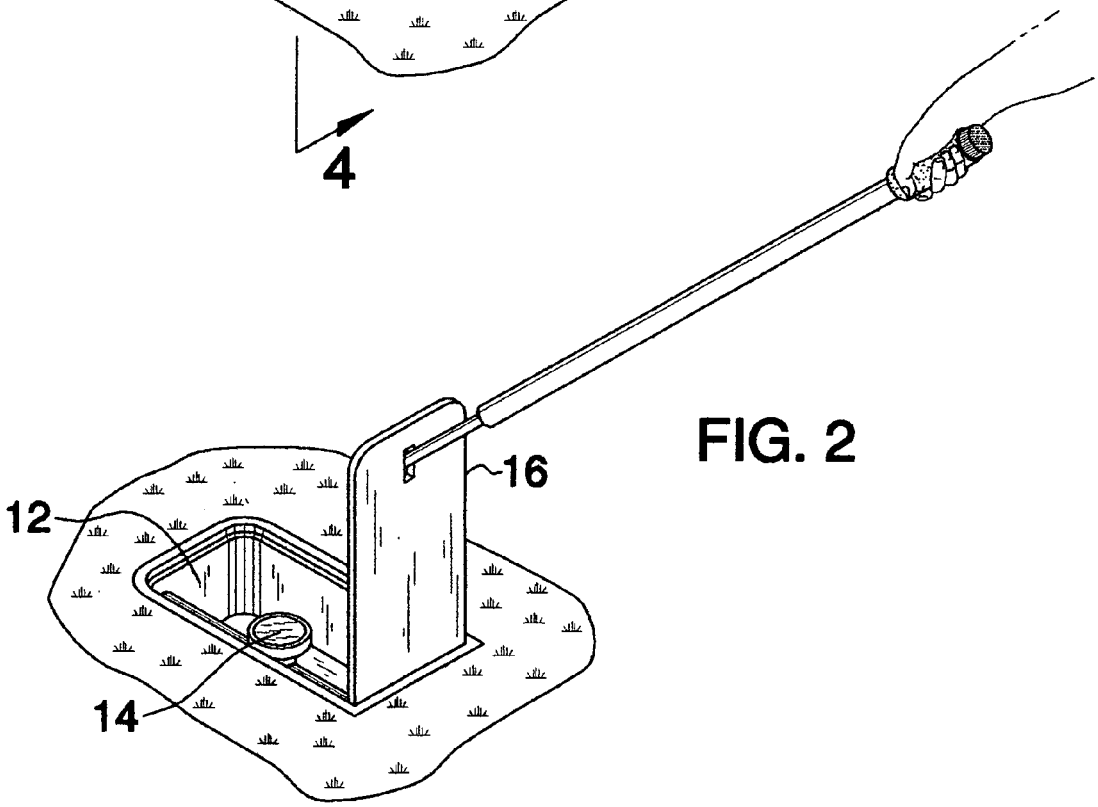
FIG. 2 is a perspective in-use view of the present invention.
Figure 3:
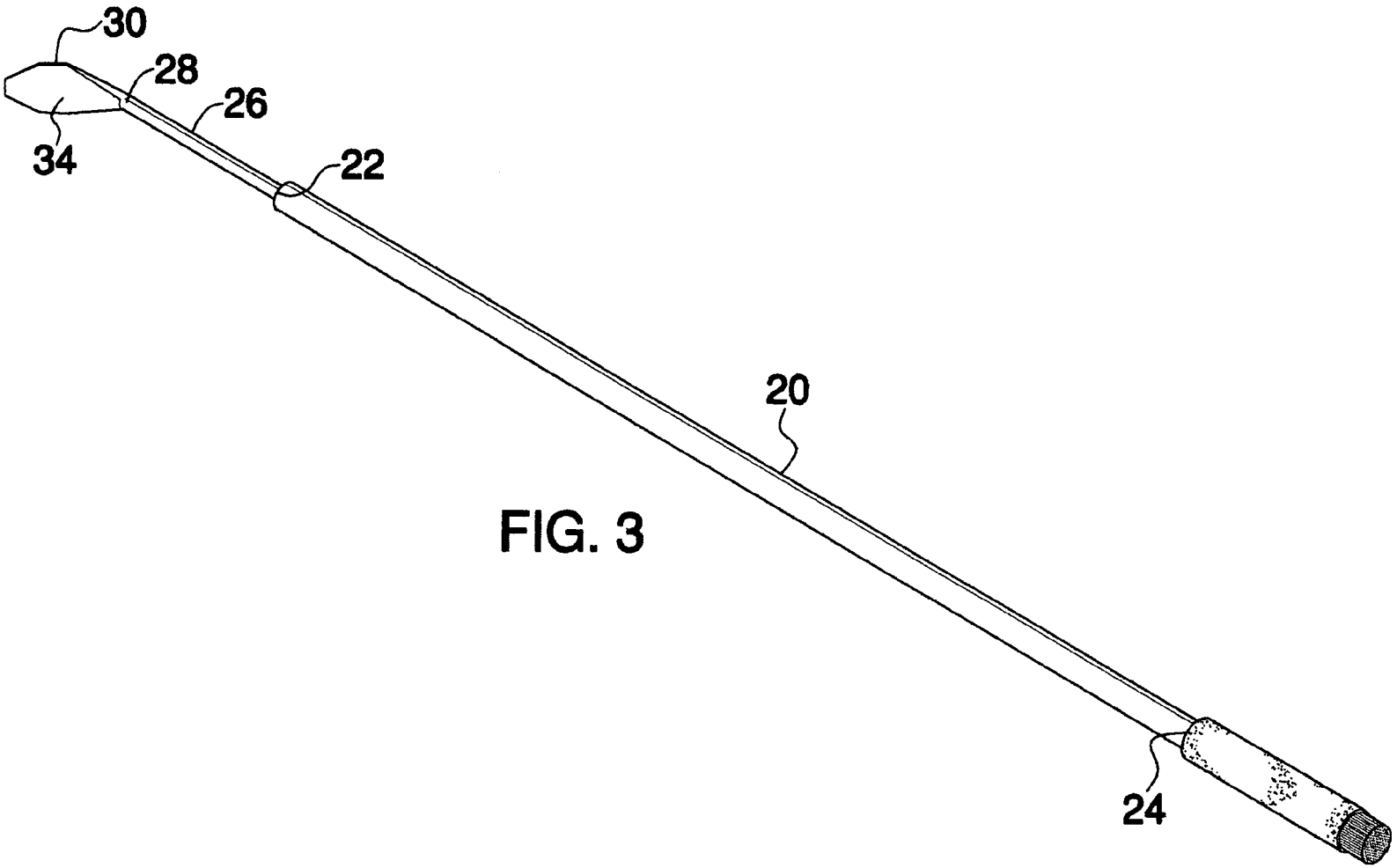
FIG. 3 is a perspective view of the present invention.
Figure 4:
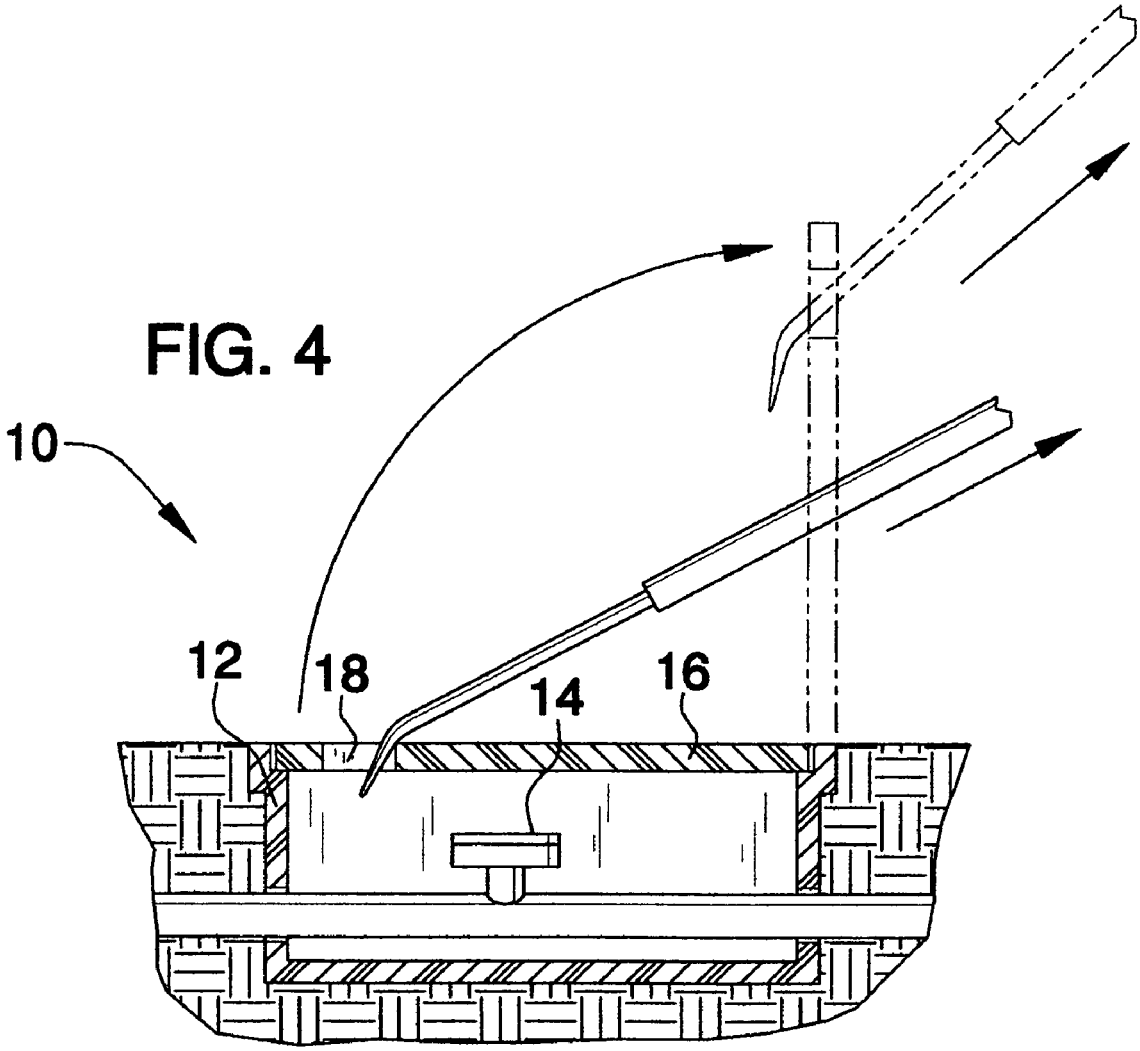
FIG. 4 is a side in-use view of the present invention.
Figure 5:
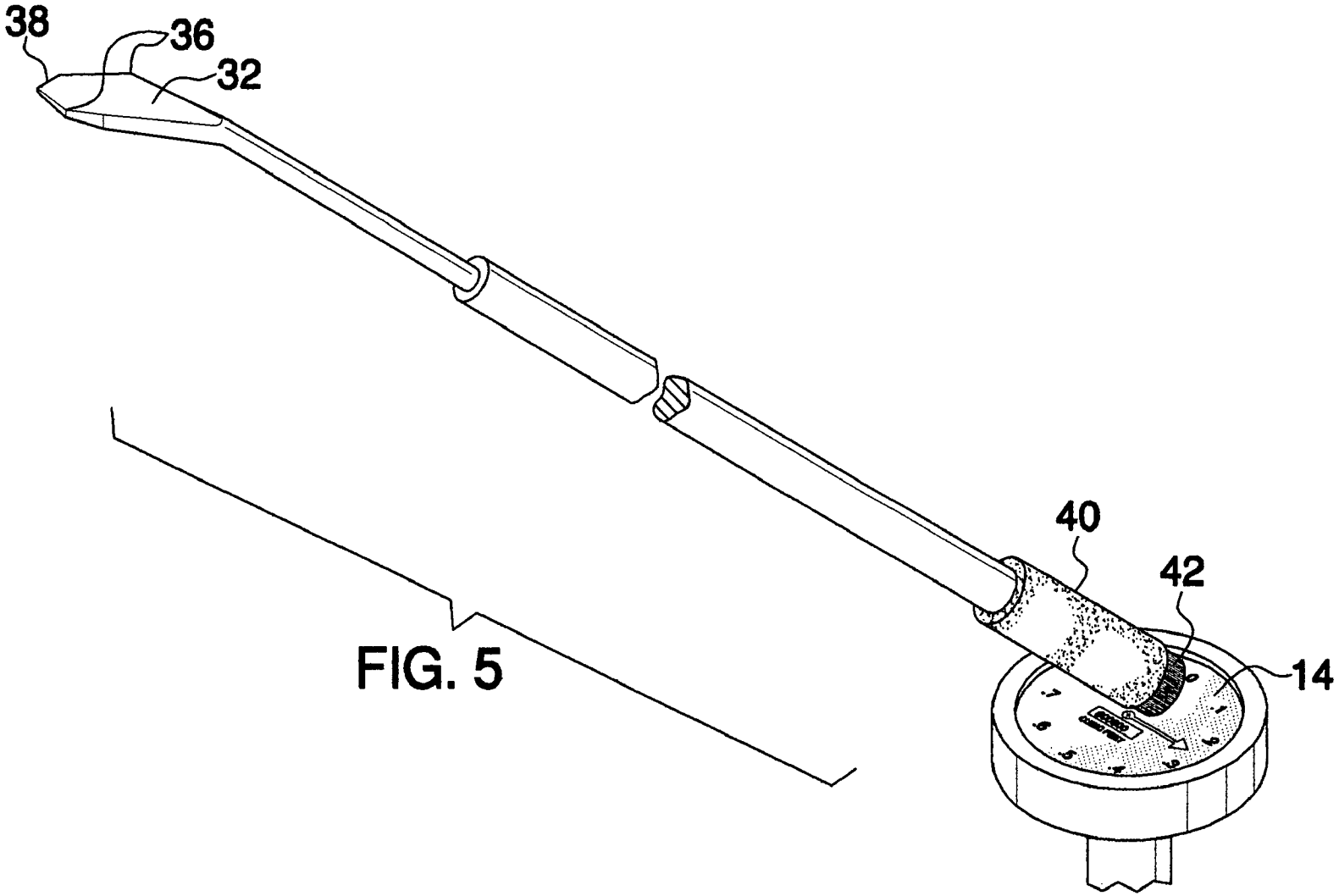
FIG. 5 is a perspective in-use view of the present invention.

With reference now to the drawings, and in particular to FIGS. 1 through 5 thereof, a new tool device embodying the principles and concepts of the present invention and generally designated by the reference numeral 10 will be described.

As best illustrated in FIGS. 1 through 5, the water meter accessing tool system 10 generally comprises a housing 12 containing a water meter 14. A cover 16 is mounted on the housing 12 and is positionable over the housing 12 in a closed configuration covering the water meter 14. The cover 16 has an opening 18 extending therethrough that has a greater length than width.

A pole 20 is elongated and has a first end 22 and second end 24. The pole 20 has a length between 2 feet and 5 feet and a width between ½ inch and 2 inches. A rod 26 is attached to and extends away from the first end 22 of the pole 20. The rod 26 is orientated parallel to the pole 20 and has a distal end 28 positioned distal with respect to the pole 20. The rod 26 has a diameter between ¼ inch and ½ inch.

A plate 30 is attached to and extends away from the distal end 28. The plate 30 has a first side 32, a second side 34, a pair of lateral edges 36 and a free end 38. The plate 30 is elongated from the free end 38 to the distal end 28. The plate 30 is angled with respect to a longitudinal axis of the rod 26. An angle between the plate 30 and the rod 26 is between 120 degrees and 170 degrees. The plate 30 has a thickness smaller than a width of the opening 18 and a width greater than the width of the opening 18. The width of the plate 30 is between ⅜ inch and ¾ inch and the thickness of the plate 30 is less than ⅜ inch. The first 32 and second 34 sides of the plate 30 comprise a shape has at least 5 sides and the free end 38 is preferably a blunt and straight edge.

A handle 40 is attached to the second end 24 of the pole 20. The handle 40 is comprised of resiliently compressible material. A brush 42 is attached to an outer end of the handle 40 positioned opposite of the pole 20. The brush 42 is selectively abutted against the meter 14 to clean the meter 14.

In use, the plate 30 may be extended through the opening 18. Rotating the plate 30 so that it is too wide to go through the opening allows the plate 30 to engage the cover 16. The cover 16 may then be lifted off of the housing 12 with the pole 20. Once the cover 16 has been removed, the meter 14 may be cleaned with the brush 42 so that it can be easily read.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water meter accessing system, said system including:

a housing containing a water meter, a cover being mounted on said housing and being positionable over said housing in a closed configuration covering said water meter, said cover having an opening extending therethrough, said opening having a greater length than width;

a pole being elongated and having a first end and second end;

a rod being attached to and extending away from said first end of said pole, said rod being orientated parallel to said pole, said rod having a distal end positioned distal with respect to said pole, a plate being attached to said distal end, said plate having a first side, a second side, a pair of lateral edges and a free end, said plate having a thickness smaller than a width of said opening and a width greater than said width of said opening, said first and second sides of said plate comprising a shape having at least 5 sides; and wherein said plate may be extended through said opening to engage said cover and said cover lifted with said pole.

2. The system according to claim 1, wherein said plate is angled with respect to a longitudinal axis of said rod.

3. The system according to claim 2, wherein an angle between said plate and said rod being between 120 degrees and 170 degrees.

4. The system according to claim 1, further including a handle being attached to said second end of said pole.

5. The system according to claim 4, wherein said handle is comprised of resiliently compressible material.

6. The system according to claim 4, further including a brush being attached to an outer end of said handle positioned opposite of said pole, said brush being selectively abutted against said meter to clean said meter.

7. A water meter accessing system, said system including:

a housing containing a water meter, a cover being mounted on said housing and being positionable over said housing in a closed configuration covering said water meter, said cover having an opening extending therethrough, said opening having a greater length than width;

a pole being elongated and having a first end and second end, said pole having a length between 2 feet and 5 feet, said pole having a width between ½ inch and 2 inches;

a rod being attached to and extending away from said first end of said pole, said rod being orientated parallel to said pole, said rod having a distal end positioned distal with respect to said pole, a plate being attached to said distal end, said plate having a first side, a second side, a pair of lateral edges and a free end, said plate being angled with respect to a longitudinal axis of said rod, an angle between said plate and said rod being between 120 degrees and 170 degrees, said plate having a thickness smaller than a width of said opening and a width greater than said width of said opening, said width of said plate being between ⅜ inch and ¾ inch and said thickness of said plate being less than ⅜ inch, said first and second sides of said plate comprising a shape having at least 5 sides, said rod having a diameter between ¼ inch and ½ inch;

a handle being attached to said second end of said pole, said handle being comprised of resiliently compressible material;

a brush being attached to an outer end of said handle positioned opposite of said pole, said brush being selectively abutted against said meter to clean said meter; and wherein said plate may be extended through said opening to engage said cover and said cover lifted with said pole.

* * * * *